United States Patent [19]

Gysling

[11] Patent Number: 4,934,684

[45] Date of Patent: Jun. 19, 1990

[54] SHEET PICKING MECHANISM

[75] Inventor: Walter Gysling, Excelsior, Minn.

[73] Assignee: National Computer Systems, Inc., Minneapolis, Minn.

[21] Appl. No.: 178,062

[22] Filed: Apr. 5, 1988

[51] Int. Cl.[5] ..... B65H 3/04

[52] U.S. Cl. ..... 271/34; 271/121; 271/227; 271/259; 271/265; 271/263

[58] Field of Search ..... 271/34, 121, 122, 123, 271/124, 125, 227, 226, 225, 250, 253, 256, 258, 261, 262, 263, 265, 228, 118, 120, 10, 37, 259

[56] References Cited

U.S. PATENT DOCUMENTS

| | | | |
|---|---|---|---|
| 467,128 | 1/1892 | Burnet et al. . | |
| 825,476 | 7/1906 | Osborn . | |
| 1,052,257 | 2/1913 | Kemper et al. . | |
| 2,104,630 | 1/1938 | Zahn . | |
| 2,214,752 | 9/1940 | Pierce . | |
| 2,224,137 | 12/1940 | Breman et al. . | |
| 2,836,416 | 5/1958 | Van Marle . | |
| 3,044,770 | 7/1962 | Breuers . | |
| 3,260,521 | 7/1966 | Moxness . | |
| 3,272,500 | 9/1966 | Van Dalen et al. . | |
| 3,825,248 | 7/1974 | Friend . | |
| 4,034,976 | 7/1977 | Lundblad . | |
| 4,158,456 | 6/1979 | Holland-Letz . | |
| 4,364,551 | 12/1982 | Rutishauser | 271/121 |
| 4,376,530 | 3/1983 | Akai | 271/121 X |
| 4,431,175 | 2/1984 | Smith | 271/34 X |
| 4,461,466 | 7/1984 | Uchida et al. . | |
| 4,523,753 | 6/1985 | Hiromori et al. | 271/34 X |
| 4,548,397 | 10/1985 | Runzi . | |
| 4,555,103 | 11/1985 | Larson | 271/121 X |
| 4,561,644 | 12/1985 | Clausing | 271/34 |
| 4,579,332 | 4/1986 | Larson | 271/121 X |
| 4,615,518 | 10/1986 | Di Blasio | 271/121 X |
| 4,634,111 | 1/1987 | Frank | 271/34 |
| 4,635,922 | 1/1987 | Roetter et al. | 271/121 X |
| 4,674,734 | 6/1987 | Ibuchi | 271/34 X |
| 4,691,912 | 9/1987 | Gillmann | 271/34 X |
| 4,696,462 | 9/1987 | Tanaka et al. | 271/121 X |
| 4,705,265 | 11/1987 | Hirota et al. | 271/122 |
| 4,718,655 | 1/1988 | Okayama et al. | 271/121 X |
| 4,730,204 | 3/1988 | Satoh et al. | 271/121 X |
| 4,761,002 | 8/1988 | Reed et al. | 271/259 X |
| 4,768,771 | 9/1988 | May | 271/121 |
| 4,795,145 | 1/1989 | Fuller | 271/121 X |
| 4,796,878 | 1/1989 | Nichelson et al. | 271/121 X |
| 4,805,892 | 2/1989 | Calhoun | 271/227 X |

*Primary Examiner*—Douglas C. Butler

*Attorney, Agent, or Firm*—Dorsey & Whitney

[57] ABSTRACT

An apparatus is shown for removing a sheet from the top of a stack of sheets and transporting it laterally in the direction of a processing station. The apparatus comprises a pick mechanism for frictionally engaging the exposed surface of the top sheet in a stack and transporting it laterally substantially in the plane of the top of the stack. An angled dam is located adjacent the pick mechanism for slidingly engaging the sheet edge and the sheet surface opposite the surface engaged by the pick mechanism to lift sheets transported by the frictional engagement device out of the plane of the top of the stack. A first thickness sensor senses the number of sheets that are transported past the dam. A brake responsive to the first thickness sensor selectively apply a friction surface to the sheet surface opposite the surface engaged by the frictional engagement device when more then one sheet is transported past the dam.

15 Claims, 11 Drawing Sheets

SHEET PICKING MECHANISM

BACKGROUND OF THE INVENTION

1. Field of the Invention

The present invention relates generally to improvements in a device for handling stacked sheets of thin materials, such as sheets of paper. More particularly, the present invention relates to a high-speed mechanism for removing single sheets of paper from the top of a stack of sheets, where such sheets are to be transported for individual processing, such as by optical scanning, after being removed from the stack.

2. Description of the Prior Art

The use of rotating friction rollers or belts to "pick", that is to engage and remove laterally, the top sheet in a stack of sheets is known. A common problem with such mechanisms is that they do not always successfully pick a single sheet from the top of the stack, because the sheet below the top sheet tends to adhere to the lower surface of the top sheet and to follow the top sheet as it moves. In some circumstances, more than one sheet will follow the top sheet. If more than one sheet is removed from the stack, this can cause severe problems, particularly in machines that scan information contained on both sides of a sheet, e.g., a two-sided, optically scanned answer form. In higher speed machines that handle hundreds or thousands of documents in sheet form per hour, even occasional malfunctions of the sheet picking mechanism can lead to numerous errors or cause significant losses in throughput. Ordinarily, to avoid errors, immediate multiple-sheet detection must occur and operator intervention will be needed to remove multiple-picked documents and restore them to the document stack. If multiple-picked documents are not recognized, jams and/or misreading of documents can occur. The greater the picking and processing speed of the equipment, the greater the throughput loss when an operator must intervene.

SUMMARY OF THE INVENTION

The present invention relates to an apparatus for removing a sheet from the top of a stack of sheets and transporting it laterally in the direction of a processing station. The apparatus comprises a pick means for frictionally engaging the exposed surface of the top sheet in a stack and transporting that sheet laterally substantially in the plane of the top of the stack. An angled dam means is located adjacent the pick means for slidingly engaging the sheet edge and the sheet surface opposite the surface engaged by the pick means to lift sheets transported by said frictional engagement means out of the plane of the top of the stack. A first thickness sensor means senses the number of sheets that are transported past the dam. Brake means responsive to the first thickness sensor selectively applies a stationary friction surface to the sheet surface opposite the surface engaged by the pick surface means when more than one sheet is transported past the dam.

It is an objective of the present invention to provide an improved sheet picking mechanism.

It is another objective of the invention to provide a sheet picking mechanism that can reliably pick a single sheet from the top of a sheet stack without drawing along with it any adjacent sheet It is a further objective of the invention to provide a sheet picking mechanism that removes the picked sheet from the sheet stack and transports it towards the processing station, halting transport motion when the presence of more than one sheet is detected after an attempt has been made to strip off the extra sheets.

It is an additional objective of the invention to provide a sheet picking mechanism that detects multiple-picked sheets and applies frictional brake means to disengage multiple-picked sheets and permit the top sheet only to be transported.

These and other objectives of the invention will become clear in the following detailed discussion of the preferred embodiment of the invention, including the following drawings.

DESCRIPTION OF THE PREFERRED EMBODIMENT

Figure 1:
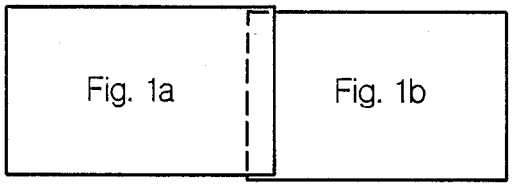
FIG. 1 is a diagram showing the organization of multiple-sheet drawing FIG. 1*a*, 1*b*.
Figure 2:
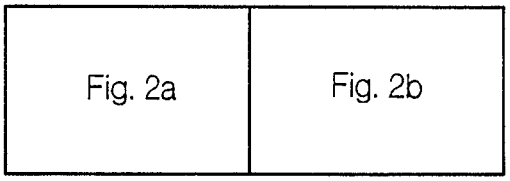
FIG. 2 is a diagram showing the organization of multiple sheet drawing FIG. 2*a*, 2*b*.

As seen in FIGS. 1*a*–1*b* and 2*a*–2*b*, the invention involves a sheet picking mechanism 100 that is part of apparatus that removes documents in sheet form from a paper stack 20 to deliver them for transport through a skew correction assembly 300 before processing in an optical scanner or other processing means (not shown) that requires presentation of single sheets in precise alignment.

In general, the invention works on a paper stack 20, the height of which is sensed by a sheet stack level sensor assembly 50 and the top sheets of which are sequentially "picked" or withdrawn by a sheet picking mechanism 100. To help ensure that only the single top sheet 22 is picked by the sheet picking assembly 100, a first thickness sensor assembly 150 is used to sense whether more than one sheet has been picked and to signal the application of a multiple-sheet brake assembly 90. There is also a second thickness sensor assembly 200 that determines whether multiple sheets have progressed past the brake assembly 90, which, if permitted to proceed, are likely to cause errors in an optical scanner head (not shown) downstream or pose problems in other downstream operations.

Figure 13:
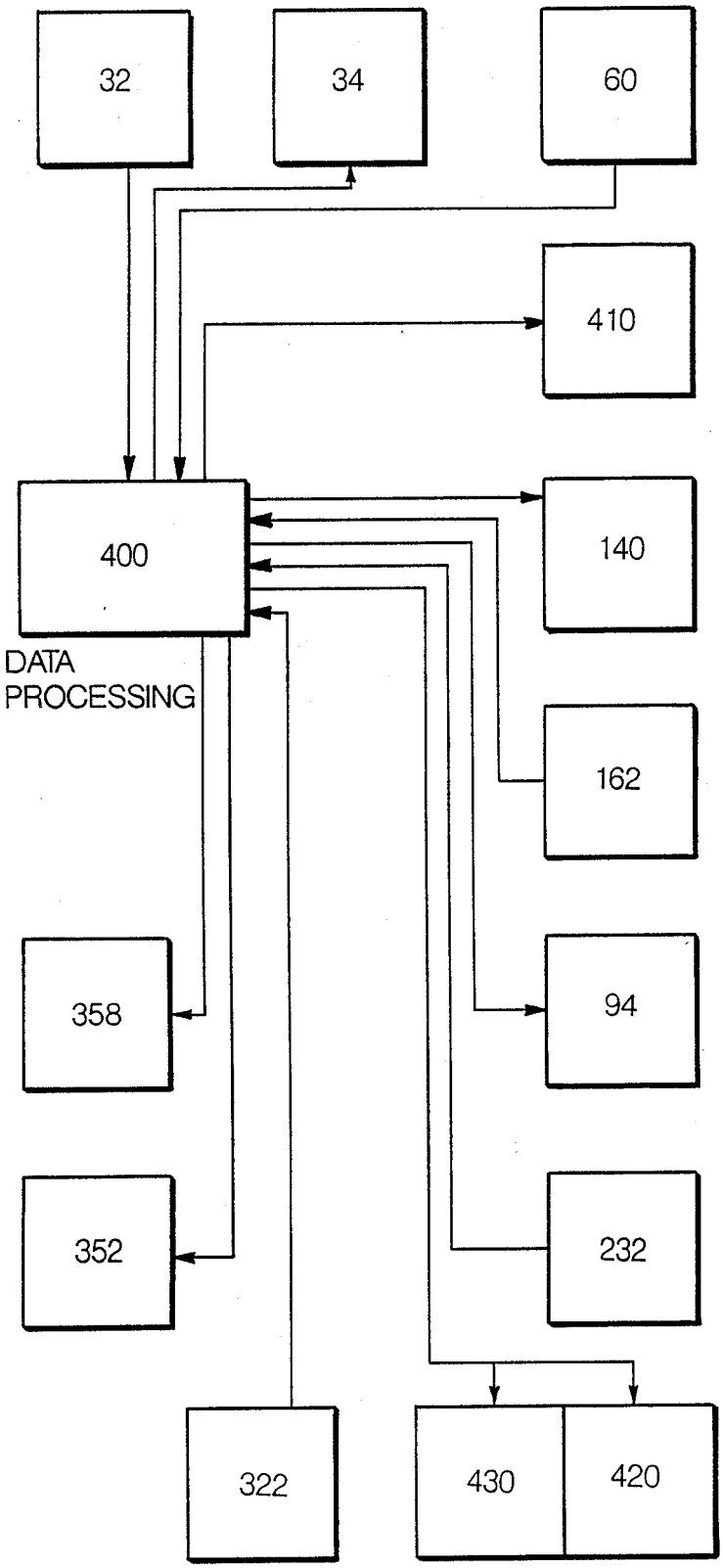
FIG. 13 is a block diagram showing the connections between various components of the control system for the present invention.

As best seen in FIGS. 1*a*, 2*a*, 4 and 5, the paper stack 20 contains generally horizontal sheets and rests against a generally vertical wall plate 10 that serves as the mounting base for most of the major components of the invention. The presence or absence of a paper stack 20 is sensed by a photo emitter 30 combined with a photo receiver 32, each of which extends through the wall plate 10. The photo emitter 30 is located above the top sheet 22 of the paper stack 20, while the photo receiver 32 is located below the sheet stack 20. The output of photo receiver 32 is communicated to a data processing means 400 that interprets the presence or absence of a sheet stack 20, and signals a stack empty condition with an appropriate indicator 34 (FIG. 13).

The level of the top sheet 22 of the sheet stack 20 is sensed by a sheet stack level sensor assembly 50. A pair of sense arms 52 are connected to a sense arm shaft 54 so that the sense arms 52 angle downward to engage the top sheet 22 of the paper stack 20. The shaft 54 passes through the wall plate 10 and connects to a shaft hub 56. Shaft hub 56 engages one end of the coiled torsion spring 51. The other end of the torsion spring 51 engages the fixed hub 55, which is part of the bearing support structure for shaft 54 in the wall plate 10. The torsion spring 51 is rotationally adjustable to produce a specified downward force at the tip of the sense arms 52. This force holds the sense arms 52 against the top of paper stack 20 (except when counteracted, as explained below). Connected to the end of the shaft 54 is an arm 57 that extends downward and connects to a magnet mount 58. The magnet mount 58 holds a magnet 59 that delivers flux to a Hall effect sensor 60 mounted on an extension flange 65 of base plate 62. The amount of flux received by and the output voltage produced by the Hall effect sensor 60 depends on the proximity of the magnet 59 to the Hall effect sensor 60. As can be observed, when the sense arms 52 are pushed upward by the top sheet 22, the magnet 59 is moved away from the Hall effect sensor 60. When the sense arms 52 move downward, the magnet 59 approaches the Hall effect sensor 60.

Figure 5:
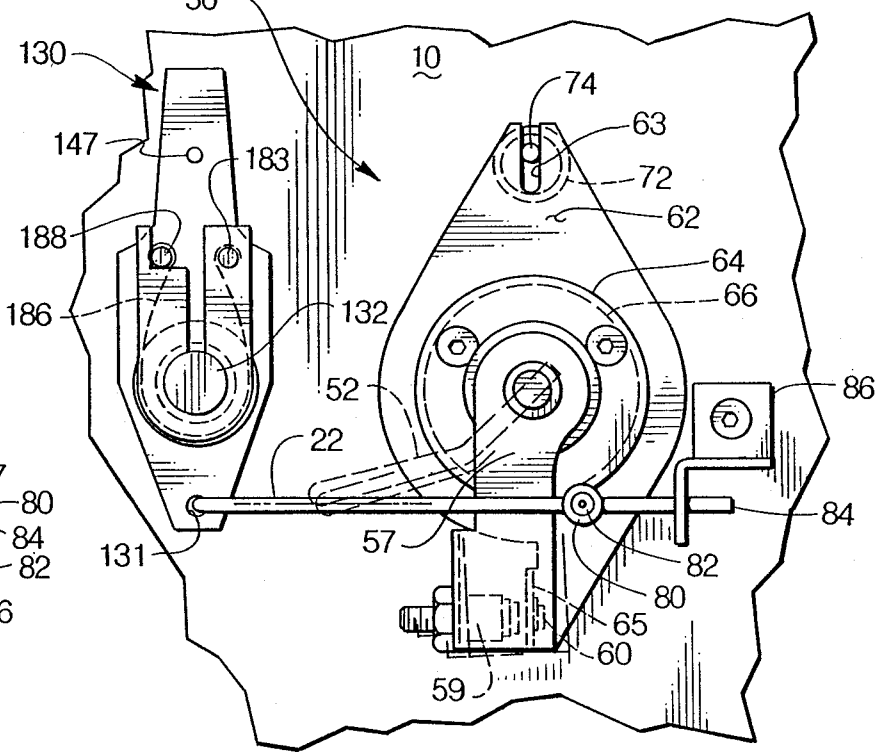
FIG. 5 is a fragmentary rear elevational detail showing elements of FIG. 4.
Figure 4:
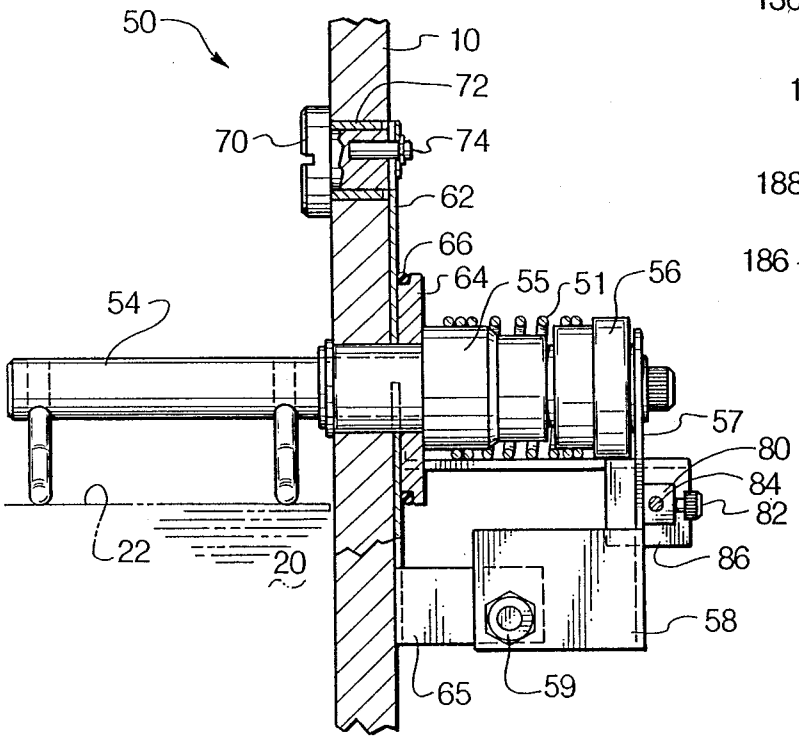
FIG. 4 is a fragmentary sectional detail in elevation taken along line 4—4 in FIG. 1 and modified to show some detail unsectioned for understanding and clarity.

As best seen in FIGS. 4 and 5, the position of the Hall effect sensor 60 is adjusted by rotation of the roughly diamond-shaped base plate 62 around a base plate hub 64. An O-ring 66 provides a frictional connection between the base plate hub 64 and the base plate 62 to aid stability of adjustment. A slotted stack height adjustment knob 70 with a stub shaft supported in a bearing sleeve 72 that passes through the wall plate 10 is used to change the position of an eccentric cam pin 74 that rests in the cam follower slot 63 of the base plate 62. By turning the stack height adjustment knob 70, the base plate 72 is rotated slightly, causing the reference position of the Hall effect sensor 60 to be changed relative to the magnet 59.

As will be explained in greater detail below, the sense arms 52 are linked to the sheet picking mechanism 100 so that sense arms 52 are lifted off the sheet stack 20 during a pick operation. This is accomplished by a stop 80 fixed on a link rod 84 by means of a stop adjustment screw 82. One end of the link rod 84 is slidably held in a bracket 86. The other end is connected to the lower end of pick lever 130, rotating on pivot shaft 132, at a hole 131. When the pick lever 130 rotates slightly clockwise (as seen in FIG. 5) on pivot shaft 132, the link rod 84 is pulled to the left (as seen in FIG. 5). Stop 80 bears against arm 57 and causes it to lift the sense arms 52. This relieves the top sheet 22 of the force applied by the sense arms 52 and helps reduce frictional attachment to the sheet below the top sheet 22. The stop 80 is also used to prevent the magnet 59 from actually contacting and damaging the Hall effect sensor 60.

Signals from the Hall effect sensor 60 are provided to a data processing means 400 (FIG. 13) that controls a stack height adjustment mechanism 410 (FIG. 13) (such as a tray connected to a motor-driven worm mechanism), to raise or lower the paper stack 20, thereby adjusting the position of the top sheet 22 relative to the sheet picking mechanism 100, discussed next. The signals from the sensor 60 are suspended when the sense arms 52 are raised by the pick lever 130, to avoid a false call for stack height adjustment.

Figure 1A:
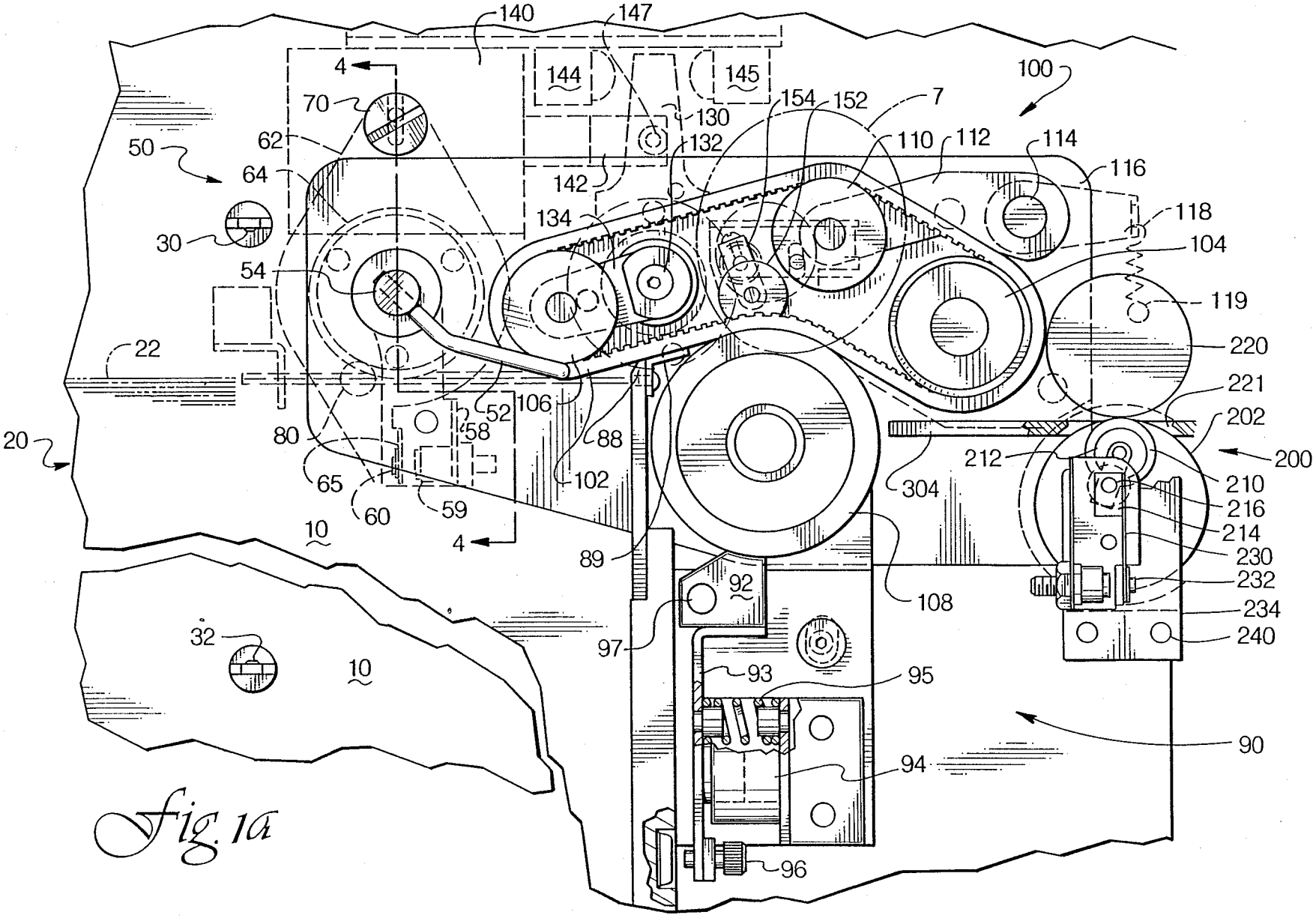
FIG. 1*a*, 1*b* represent a front elevational view of the invention with parts cut away.

In the preferred embodiment, the sheet picking mechanism 100 utilizes a pick means such as feed belt 102 with a high-friction outer surface and with internal teeth that permit it to be positively driven by a toothed pick drive roller 104. The drive roller 104 is mounted on a pick drive shaft 105 driven by belt 109 in sheave 107 located at the right hand end (as seen in FIG. 1*a*) of the feed belt 102. A clutch 410 with clutch plate 117 controls motion of the feed belt 102. Rotation of the feed belt 102 is counterclockwise as viewed in Fig. 1*a*. At the left hand end of the feed belt 102 is a pick roller 106 that is movable up and down on a pick crank 134 that moves in a short arc around a pivot shaft 132 to selectively engage the top sheet 22 or to remain above it. The pivot shaft 132 passes through the wall plate 10.

Figure 14:
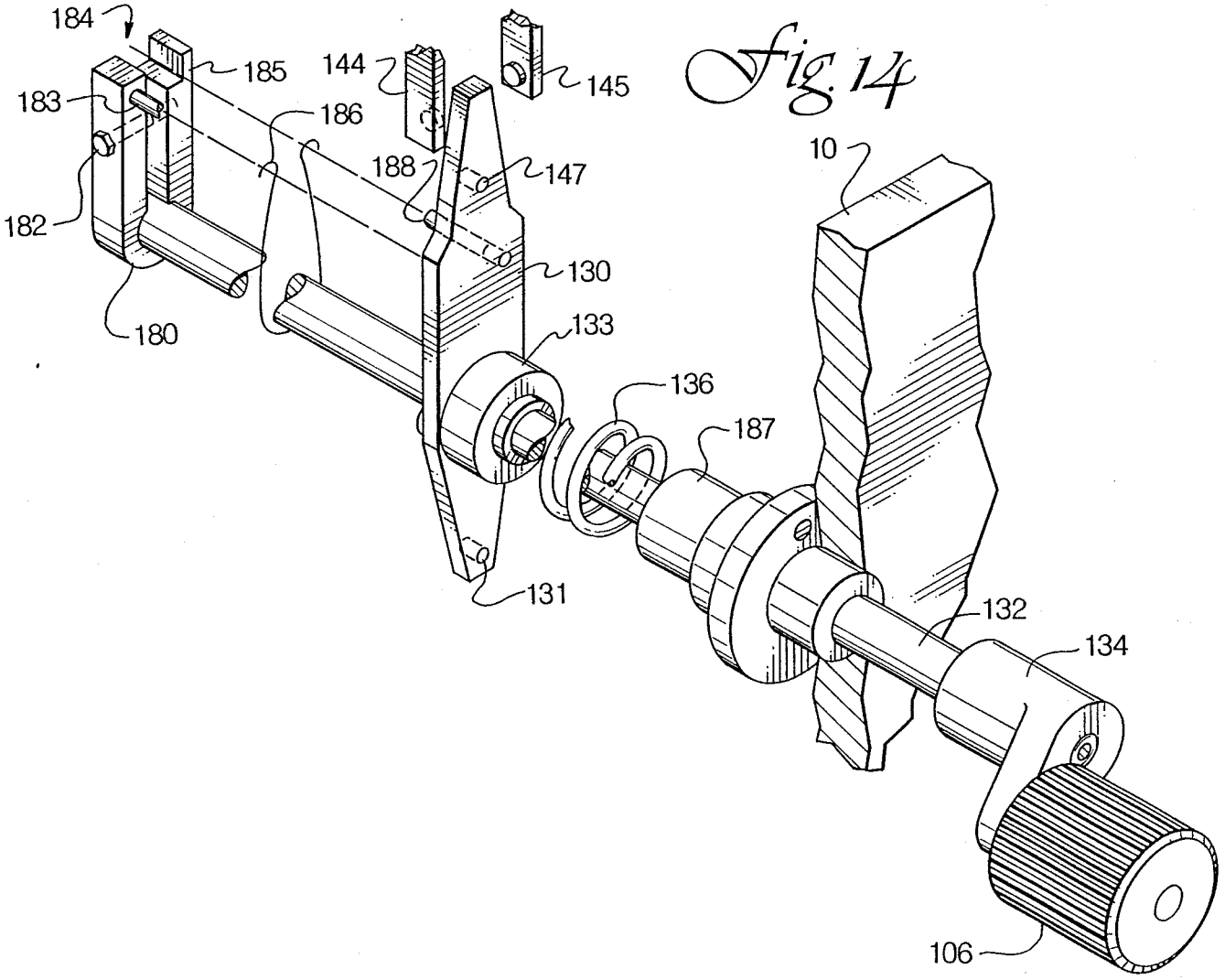
FIG. 14 is an exploded perspective view of the linkage used to raise and lower the pick roller and limit the force it exerts.

As best seen in FIG. 14, the pick roller 106 is connected to its actuator by a linkage that limits the amount of downward force that the pick roller 106 and the feed belt 102 can exert on the stack 20. On the opposite side of the wall plate 10 from the picker belt 102, a roughly U-shaped torque arm 180 is clamped onto the end of the pick pivot shaft 132 utilizing clamp bolt 182. Adjacent to the torque arm 180 and freely rotating on the shaft 132 is a pick lever 130 with a pin 188 extending into the notch 184 in one leg of torque arm 180. This notch 184 allows the pick lever 130 rotational play within the angular travel allowed by the free play of pin 188. The torque arm 180 also has a pin 183 extending toward the pick lever 130. In the small gap between the torque arm 180 and pick lever 130 the free ends of a U-spring 186 engage pin 183 of the torque arm 180 and pin 188 of the pick arm 130. At the rest position the spring force of the U-spring 186 forces the pin 188 of the pick arm 130 against the notch tab 185 of the torque arm 180.

Encircling the shaft 132 is a return spring 136, one end of which engages the hub 187 attached to the wall plate 10. The other end of return spring 136 engages the hub 133 connected to pick lever 130. A pick solenoid 140 is connected to the pick lever 130 via a ram 142 attached at pin 147. A pair of opposed stops 144, 145 is used to limit the travel of pick lever 130 in either direction. Return spring 136 is adjusted to urge pick lever 130 to rest against stop 145.

The purpose of this structure is to provide a limited and controlled force applied by the pick roller 106 against the paper stack 20 during a picking operation. In a typical pick operation the pick solenoid 140 causes the pick lever 130 to be pulled from the rest stop 145 all the way to the end-of-stroke stop 144. The total stroke as determined by the setting of the rest and end of stroke stops 145, 144, respectively, results in a corresponding magnitude of angular travel of pick crank 134 and a downward pick stroke of pick roller 106. If, however, during this sequence the pick roller 106 contacts the paper stack 20 with a force as determined by the spring rate of the U-spring 186 before the pick lever 130 has reached the end-of-stroke stop 144, further rotation of crank 134 and motion of pick roller 106 will cease and yet allow the pick arm 130 to continue its travel. As it does, pin 188 is unseated from notch tab 185 and, acting through the U-spring 186, causes a limiting pick torque on shaft 132. For best pick operation it has been found that the feed belt 102 should contact the top sheet 22 with a relatively small force—just enough to provide adequate friction for the feed belt 102, without providing a significant frictional force between the top sheet 22 and the sheet immediately below it. A force of about 150 grams is appropriate. The spring rate of the U-spring 186 is selected to achieve the desired downward force.

Between its left and right ends the feed belt 102 runs over a tension roller 110 that is supported on a tensioner lever arm 112. The arm 112 moves in a short arc around tensioner pivot shaft 114 that passes through the wall plate 10 and is attached to a crank 116. A tensioner tension spring 118 pulls down on the free end of the crank 116 to lift the tension roller 110 and supply tension to the feed belt 102. The tension spring 118 has one end anchored to a tensioner post 119. The underside of the feed belt 102 runs over an idling retard roller 108 that gives the lower course of the feed belt 102 a broad inverted V-shape. That is, toward its left end the lower course of the feed belt 102 slopes upward toward the idler retard roller 108. After curving over the idling retard roller 108, the feed belt 102 slopes downward toward its right end.

The outer surface of the feed belt 102, when lowered into contact with the top sheet 22 by actuation of solenoid 140, frictionally engages the upper surface of this top sheet 22 and draws it toward the right (as seen in FIG. 1*a*) and against the sloped dam 88 located just below the feed belt 102, roughly aligned with the axis of the pivot shaft 132. The slope of the dam 88 causes the leading edge of a sheet (or multiple sheets) engaged by the feed belt 102 to be lifted toward the contact point between the feed belt 102 and the top of the dam 88. This helps to lift the top sheet 22 partially out of frictional contact with the sheet below and aids picking of a single sheet. After passing over the dam 88, the leading edge of the top sheet 22 (or multiple sheets) is guided between a paper ramp 89 and the feed belt 102 towards the idling retard roller 108 that contacts the feed belt 102 and forms an upward bend in its lower surface.

Figure 6:
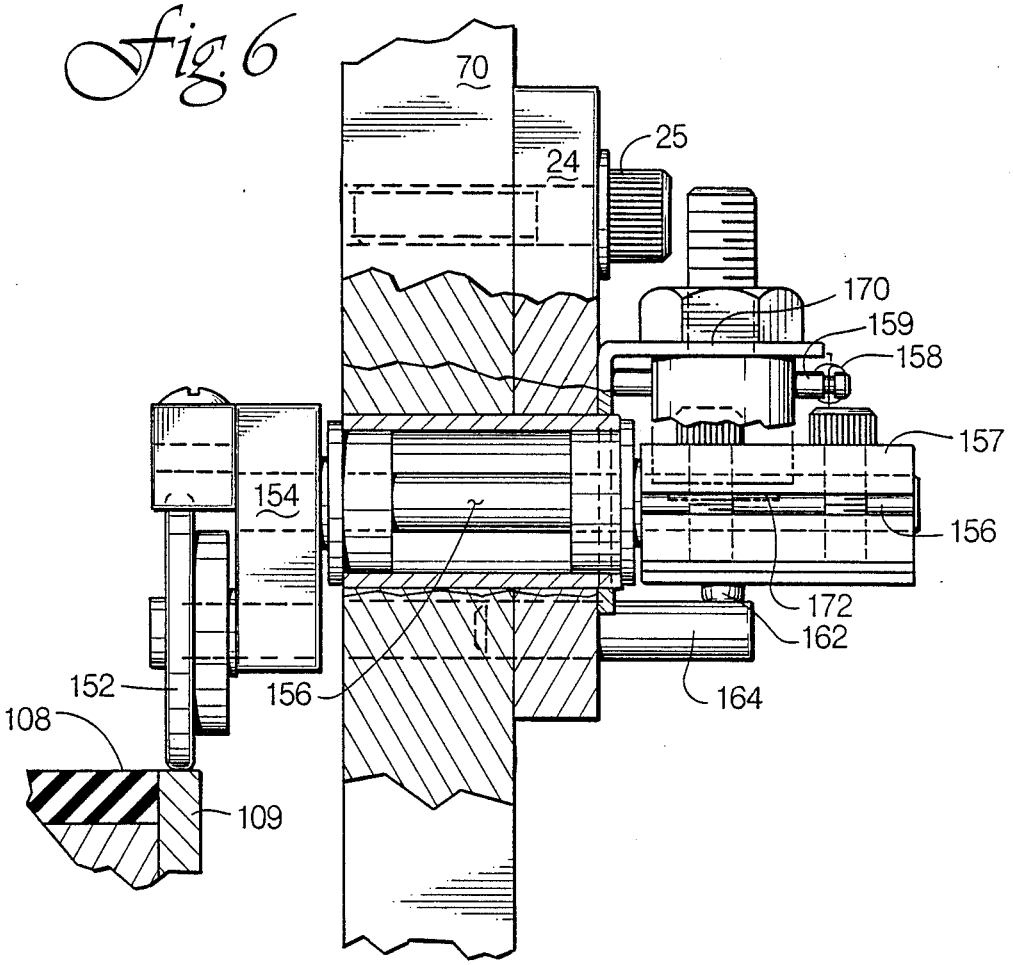
FIG. 6 is a fragmentary right end elevational detail with parts cut away showing elements of a sheet thickness monitor means with parts cut away.
Figure 8:
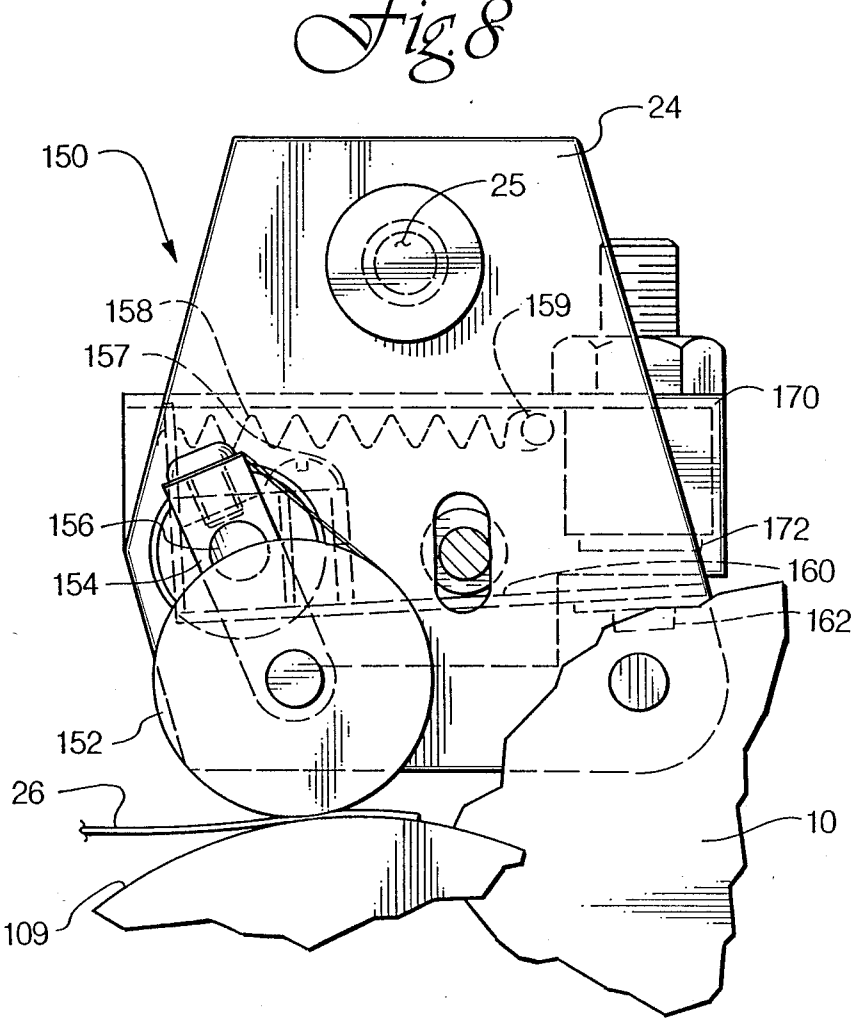
FIG. 8 is a view similar to that of FIG. 7 with movable parts shown in a secondary position
Figure 7:
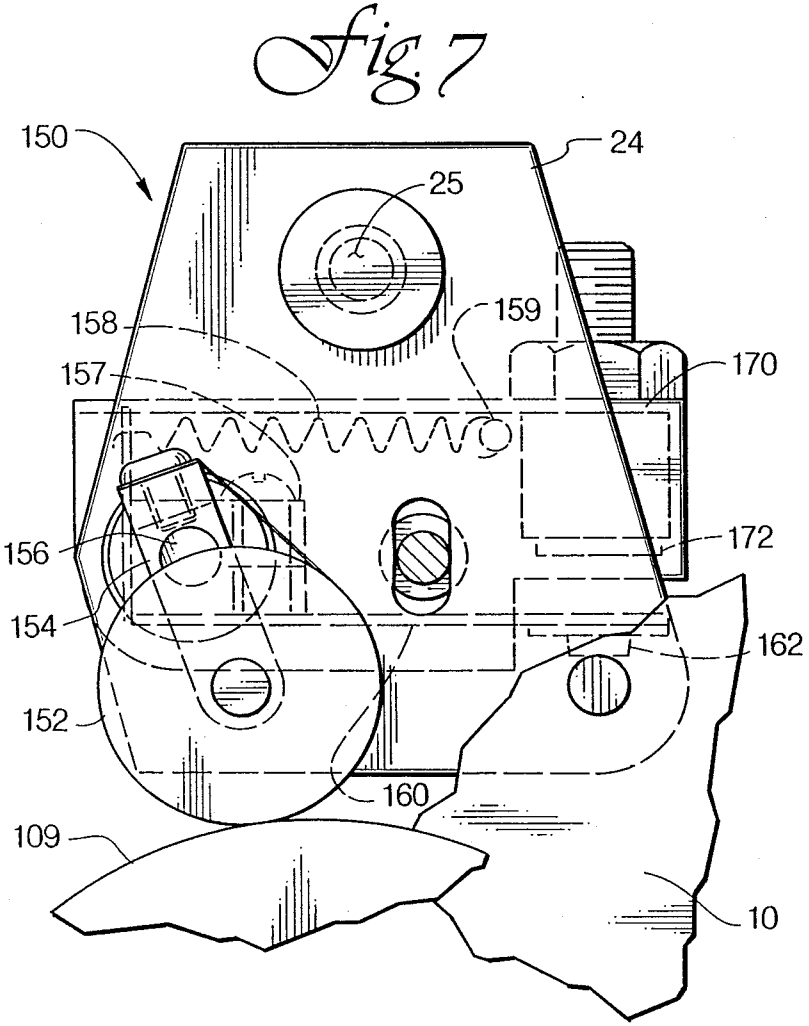
FIG. 7 is an enlarged fragmentary front detail and elevation taken from the area encircled at 7 in FIG. 1 and having parts cut away and removed.

At the idling retard roller 108 is located the first paper thickness sensor means or assembly 150. As best seen in FIG. 6, at the end of the idling retard roller 108 closest to the wall plate 10, is a rim 109 (of metal or other suitable hard, wear-resistant material). Bearing against the metal rim 109 is a metal thickness sensor wheel 152 rotatably mounted on a thickness sensor wheel arm 154, which is, in turn, clamped to a thickness sensor shaft 156. The thickness sensor shaft 156 passes through the wall plate 10 and a thickness sensor base plate 24 held to the wall plate 10 by a fastener 25, where it is received in a clamp 157. As best seen in FIGS. 7 and 8, attached to the clamp 157 is an L-shaped sensor arm 160 that has a Hall effect sensor 162 located at the end of the horizontal portion of the sensor arm 160. At the end of the vertical portion of the sensor arm 160, a return spring 158 in connected, the other end of which is connected to a post 159 attached to the base plate 24. Corresponding to the Hall effect sensor 162 is a magnet 172 that is mounted to the base plate 24 by a magnet mount 170.

As can be seen in FIG. 8, when a picked sheet of paper 24 (or more than one) enters the gap between the metal rim 109 and the thickness sensor wheel 152, the thickness sensor wheel 152 is deflected upward, causing the horizontal portion of the sensor arm 160 with sensor 162 to move closer to the magnet 172. Because the dimensions of the metal rim 109, the thickness sensor wheel 152 and the remaining linkage elements leading to the Hall effect sensor 162 and the corresponding magnet 172 are held to close dimensions in a defined geometry, the voltage output of the Hall effect sensor 162 (communicated to the data processing means 400 (FIG. 13)) can provide accurate information on the amount of displacement of the thickness sensor wheel 152. This permits a determination to be made as to the thickness of the sheet or sheets present, from which a determination can be made whether no sheet or only one sheet is present or whether more than one sheet is present. If more than one sheet is present, this is signalled in the data processing means 400, which can issue control signals to actuate the brake assembly 90, discussed next.

Referring again to Fig. 1*a*, the various elements of the brake assembly 90 can be seen. The purpose of the brake assembly 90 is to selectively provide frictional engagement to the lower surface of a group of two or more sheets that has been sensed by the thickness sensor assembly 150. To do this, the brake assembly 90 utilizes the idling retard roller 108, which normally rotates freely clockwise (as seen in FIG. 1*a*) to permit a picked sheet 26 (FIG. 8) to proceed in the direction in which it is urged by the feed belt 102. When multiple sheets are detected, the free motion of the idling retard roller 108 is stopped by application of a brake shoe 92 (pivoted on pin 97) to the outer periphery of the idling retard roller 108. The brake shoe 92 is attached to an arm 93 that moves in response to actuation of a brake electromagnet 94 and is returned to its rest (non-braking) position by a compression return spring 95. The position of the brake shoe 92 relative to the periphery of the idling retard roller 108 when the brake assembly 90 is not actuated is determined by a brake gap adjustment screw 96. Because the retard roller 108 has a high friction surface, when it stops rolling, significant friction force is applied to the sheet surface that it contacts.

Figure 2A:
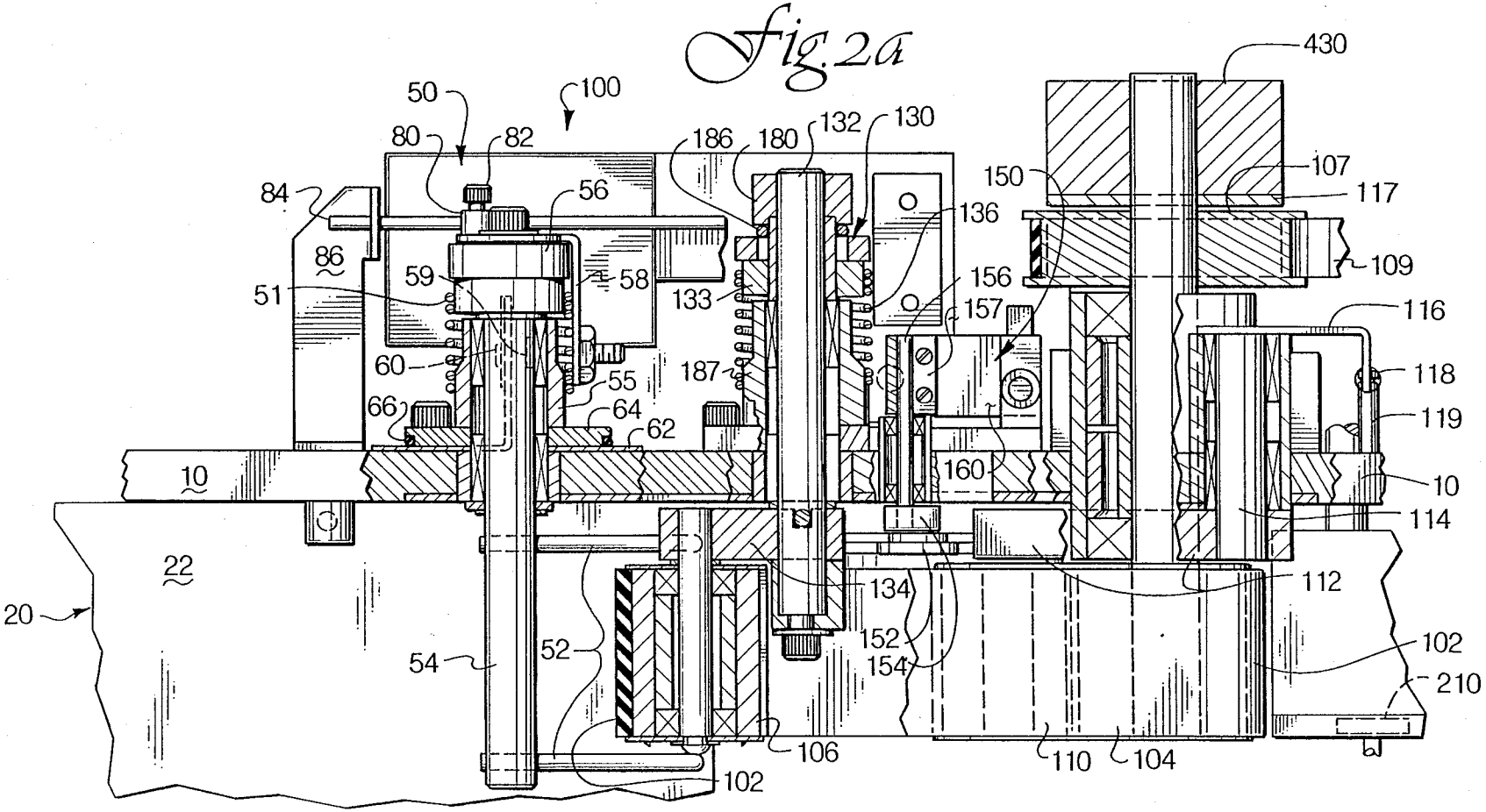
FIG. 2*a*, 2*b*, represent a top plan view of the invention with parts cut away.

While actuation of the brake assembly 90 will normally be sufficient to strip off from the top sheet 22 one or more lower sheets that have proceeded past the dam 88, in some cases strong adhesion between sheets prevents this. In that case, multiple sheets will proceed past the dam 88 and over the idling retard roller 108 toward the transport table 304 leading to the skew correction assembly 300. To prevent multiple sheets from proceeding without an error condition being noted, a second paper thickness sensor means or assembly 200 is used. The second paper thickness sensor assembly 200 is very similar in structure to the first paper thickness sensor assembly 150. As seen in Fig. 1*a*, in this instance, the measuring gap is defined by an idling infeed roller 220 located above the transport table 304 and a second thickness sensor wheel 210 that contacts the lower surface of the idling infeed roller 220 through a sensor window 221 in the transport table 304. The second thickness wheel 210 is connected to a crank 212 connected to a pivot shaft 216. This pivot shaft 216 is supported on a base plate 240 (similar to base plate 24) mounted on the wall plate 10 and connects via a clamp 214 to a sensor arm 230 that carries a Hall effect sensor 232. This Hall effect sensor 232 has a corresponding magnet 234 that provides the flux to be sensed. The output of this Hall effect sensor 232 is also provided to the data processing means 400 for purposes of signalling a picking error that was not corrected by the brake assembly 90 and must be corrected by operator intervention. Accordingly, the data processing means 400 signals by an appropriate indicator 420 the multiple sheet condition and stops the motion of picker belt 102 via a drive clutch 430 (FIGS. 2*a*, 13).

Figure 1B:
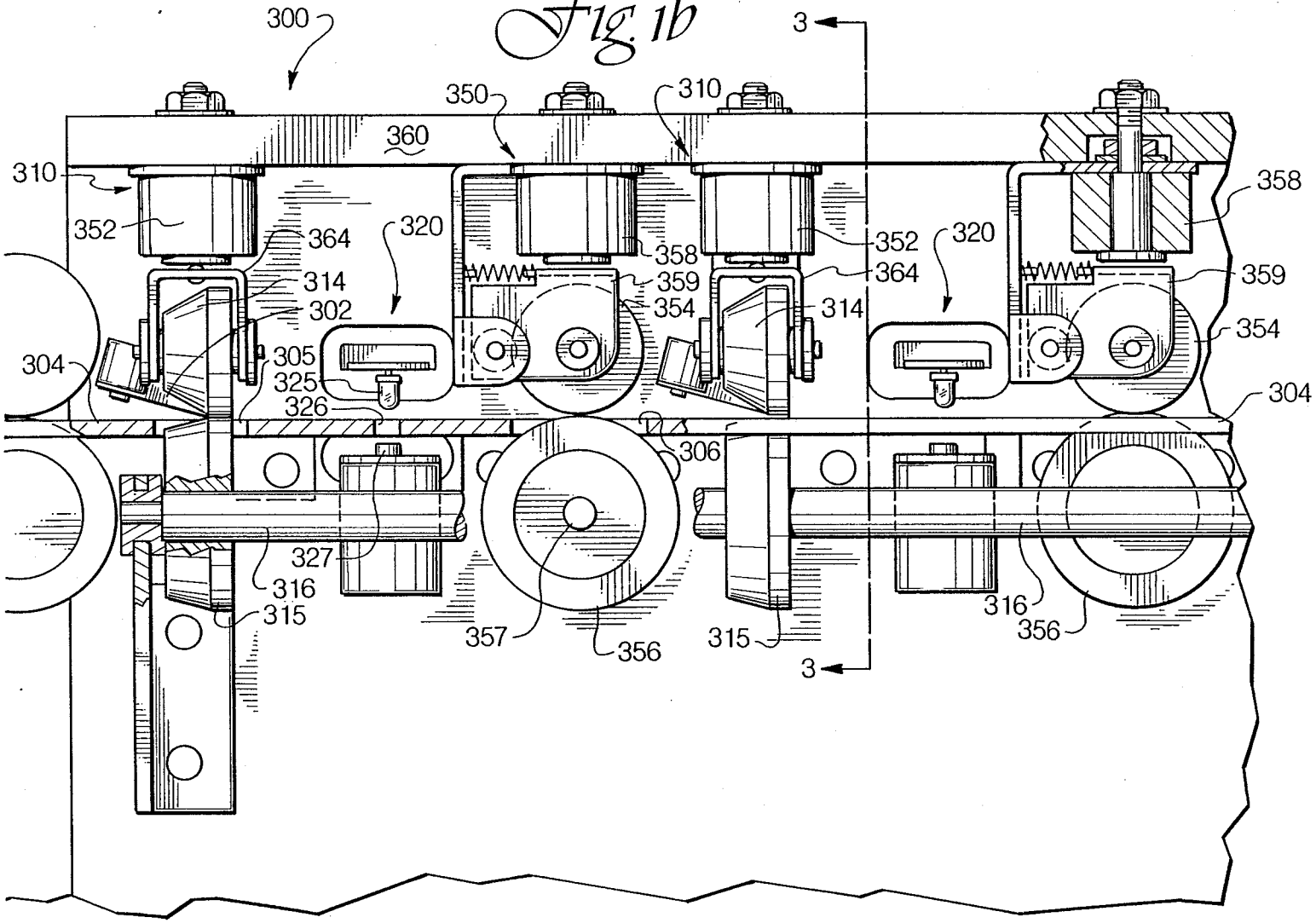
Figure 2B:
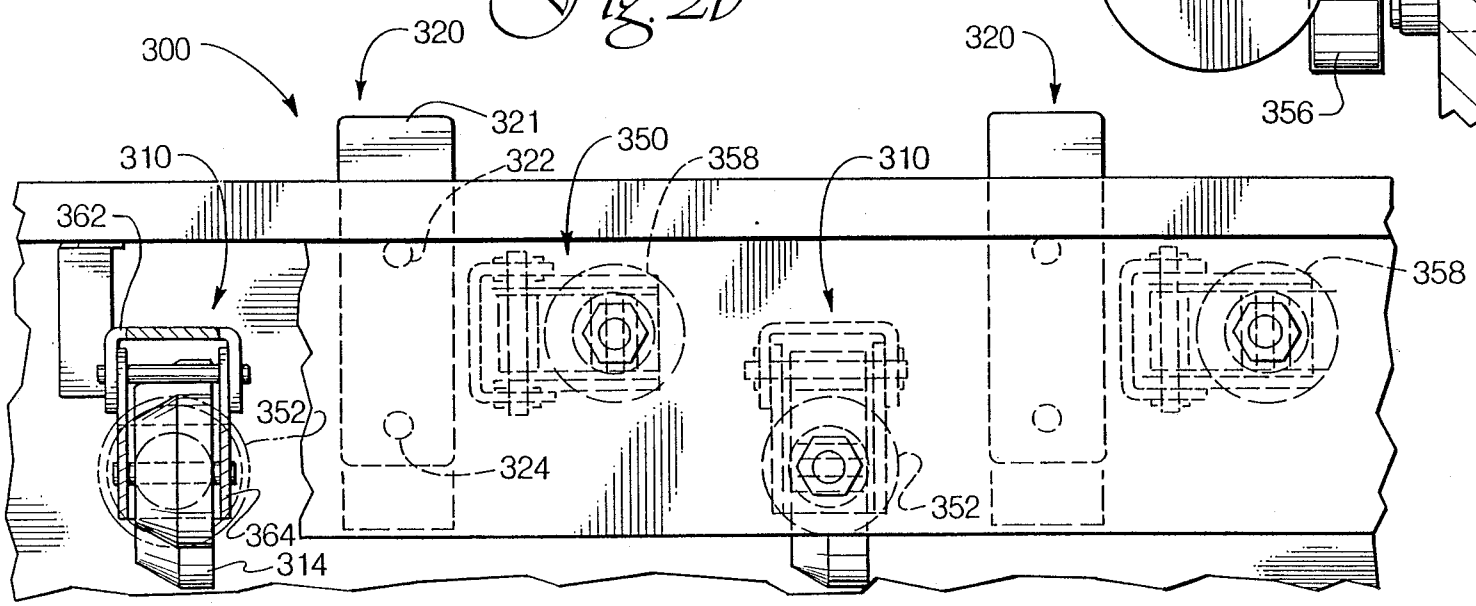

In the typical situation where a single sheet 26 has been picked and only this single sheet 26 exits from the gap between the idling retard roller 108 and the feed belt 102, this sheet 26 is delivered onto the transport table 304 for handling by the skew correction assembly 300. As best seen in FIGS. 1*b*, 2*b*, the presence of a sheet and a skew problem are both sensed at a skew sensor station 320. (FIG. 2*b* shows two of the three such stations actually present in the preferred embodiment.) The skew sensor station 320 consists of a photo sensor mount 321 carrying a skew photo sensor set 322 immediately adjacent the wall plate 10 and a sheet sensor set 324 laterally spaced therefrom. As best seen in FIG. 1*b*, a sensor set consists of a photo emitter 325 passing light through a hole 326 in the transport table 304 to a photo sensor 327. The output of the photo sensor of skew photo sensor set 322 is communicated to data processing means 400 to initiate skew correction.

Transport of a sheet through the skew correction assembly 300 is provided by a set of drive rollers 356 located beneath the transport table 304, contacting opposed transport idler rollers 354 through transport openings 306 in the transport table 304. Each transport drive roller is driven by a drive shaft 357. During transport of a sheet, the transport drive roller 356 and its corresponding idler roller 354 remain in contact with opposite sides of a transported sheet. However, if transport must be interrupted for skew correction, this can be done by actuating transport solenoid 358 on solenoid mounting plate 360 to magnetically attract transport idler bracket 359 carrying transport idler roller 354 to draw transport idler roller 354 out of contact with transport drive roller 356.

Figure 3:
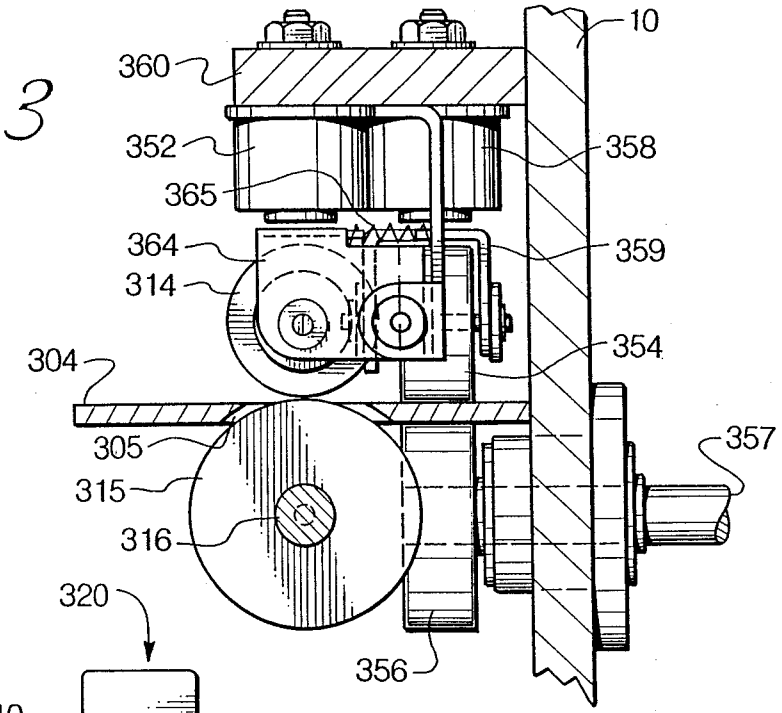
FIG. 3 is a sectional detail in elevation taken along line 3—3 in FIG. 1.

If the skew photo sensor set 322 signals the data processing means 400 that a picked sheet 26 being transported is not edge-aligned with the wall plate 10, then the skew roller assemblies 310 must be actuated. Each skew roller assembly 310 consists of a beveled skew drive roller 315 on skew drive shaft 316 located below the track table 304 with an opposing skew idler roller 314 above the track table 304. The skew drive roller 315 and the skew idler roller 314 are on opposite sides of a window 305 in the track table 304 and are not normally in contact. However, when a skew problem is indicated by skew photosensor set 322, data processing means 400 actuates transport solenoids 358 to interrupt the action of the transport drive rollers 356 and signals skew solenoids 352 mounted on solenoid mounting plates 360 to drop skew idlers 314 (with the aid of compression springs 365) onto skew drive rollers 315, which are continuously driven by skew drive shaft 316. The rotational directional of rollers 315 is such (clockwise, as seen in FIG. 3) that a skewed sheet is driven against the wall plate 10. As soon as the skew photosensor set 322 senses that the picked sheet 26 being transported is properly positioned, data processing means 400 signals the skew solenoids 352 and the transport solenoids 358 to switch states, permitting transport idler rollers 354 to drop onto transport drive rollers 356 to continue to transport the sheet 24. At the same time, the skew rollers 315 and the skew idlers 314 are separated by the skew solenoids 352 raising the skew idlers 314.

ALTERNATE THICKNESS SENSOR ASSEMBLIES

For proper operation of the invention, it is important that the first and second thickness sensor assemblies 150, 200 function properly While the preferred embodiment previously discussed has been found effective, the invention also encompasses certain alternative designs, as shown in FIGS. 9–10 and 11–12. Although these alternative designs are shown only for the first thickness sensor assembly 150, it will be clear that they could be adapted with slight changes to the second thickness sensor assembly 200.

Figure 10:
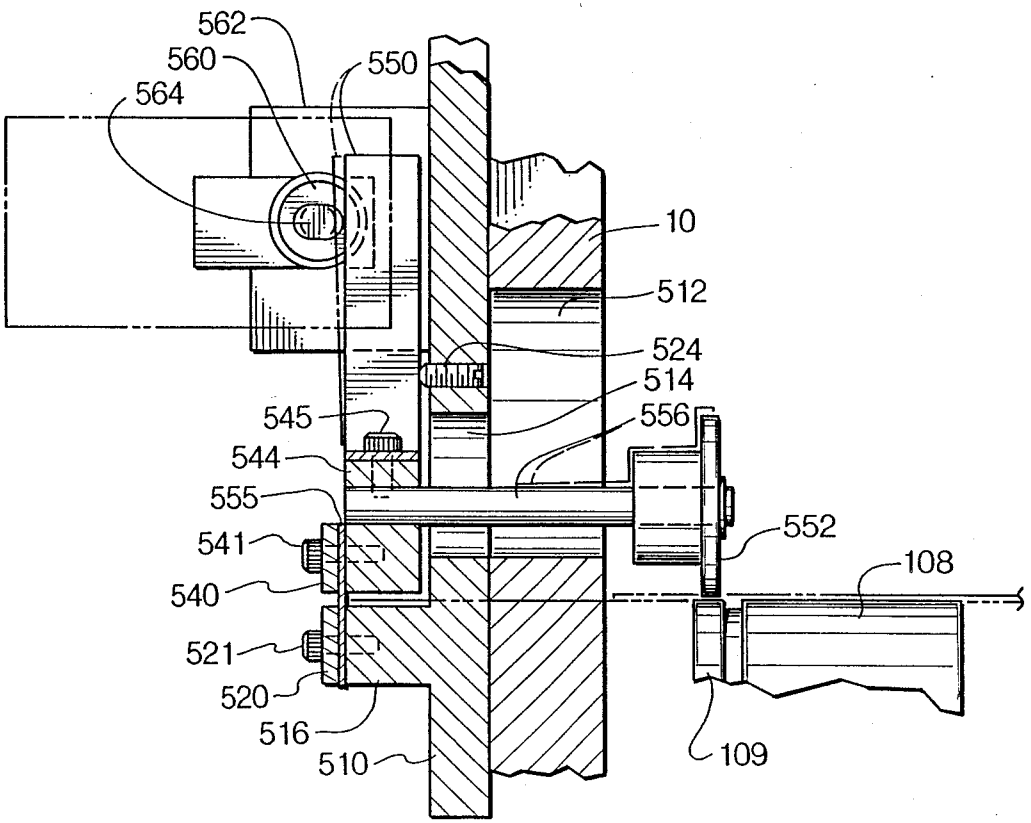
FIG. 10 is an enlarged fragmentary left-hand view of elements of FIG. 9 with parts cut away.
Figure 9:
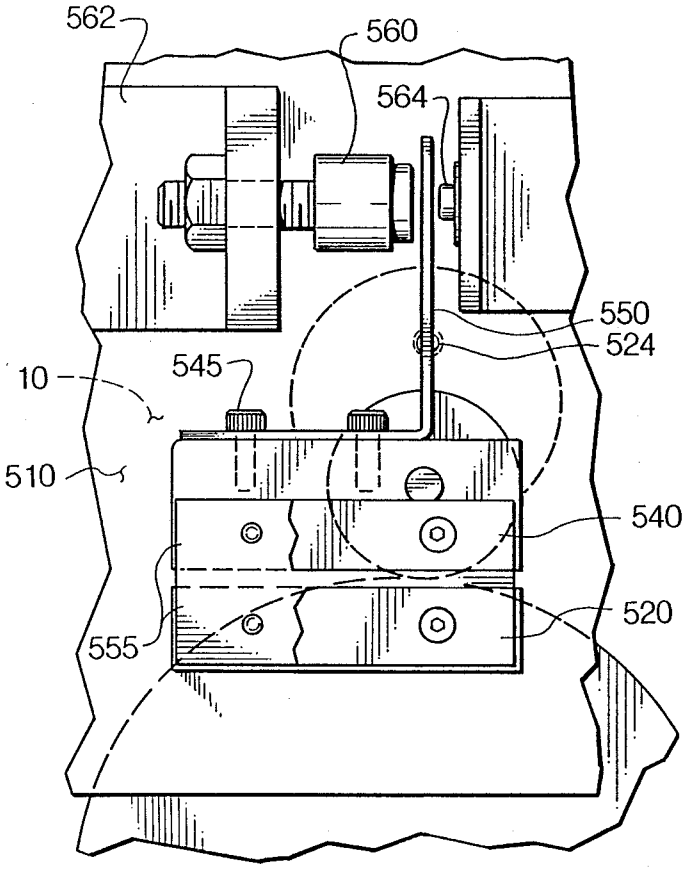
FIG. 9 is an enlarged fragmentary rear detail in elevation of a first alternate paper thickness monitor means.

A first alternative embodiment is shown in FIGS. 9–10. In this embodiment the metal rim 109 of the idling retard roller 108 is contacted by a thickness sensor roller 552 that is journaled for rotation on a thickness sensor shaft 556. The thickness sensor shaft 556 passes through a window 512 in the wall plate 10 and through an additional window 514 in a mounting plate 510 attached to the back of the wall plate 10. The left end of the thickness sensor shaft 556 is press-fit into a bracket 544. A bend hinge is formed between the bracket 544 and a flange 516 on the mounting plate 510 by a thin spring steel plate 555. The plate 555 is clamped to the bracket 544 by a clamp 540 and a screw 541. The plate 555 is also clamped to the flange 516 by a clamp 520 and a screw 521. Also attached to the bracket 544 by a pair of screws 545 is an L-shaped interrupter leaf 550. The upper end of this interrupter leaf 550 is located in a gap between a magnet 560 mounted on a bracket 562 extending from the mounting plate 510 and a Hall effect sensor 564 that is mounted directly opposite the magnet 560. The rest position of the interrupter leaf 550 and the sensor shaft 556 may be accurately set by using preload set screw 524 passing through the mounting plate 510. As can be seen, when the thickness sensor roller 552 encounters one or more sheets of paper it tilts the interrupter leaf 550 further into the gap between the magnet 560 and the Hall effect sensor 564. The resulting change in voltage from the Hall effect sensor 564 can be used to determine the thickness of sheets encountered at the gap between the thickness sensor roller 552 and the metal roller 109.

Figure 12:
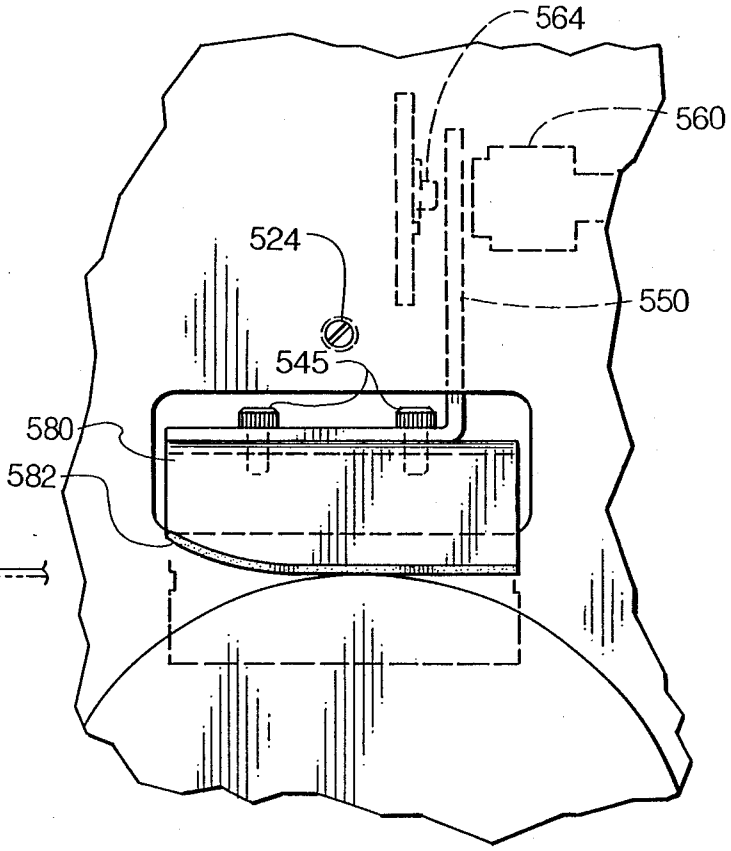
FIG. 12 is an enlarged front detail in elevation of the elements of FIG. 11.
Figure 11:
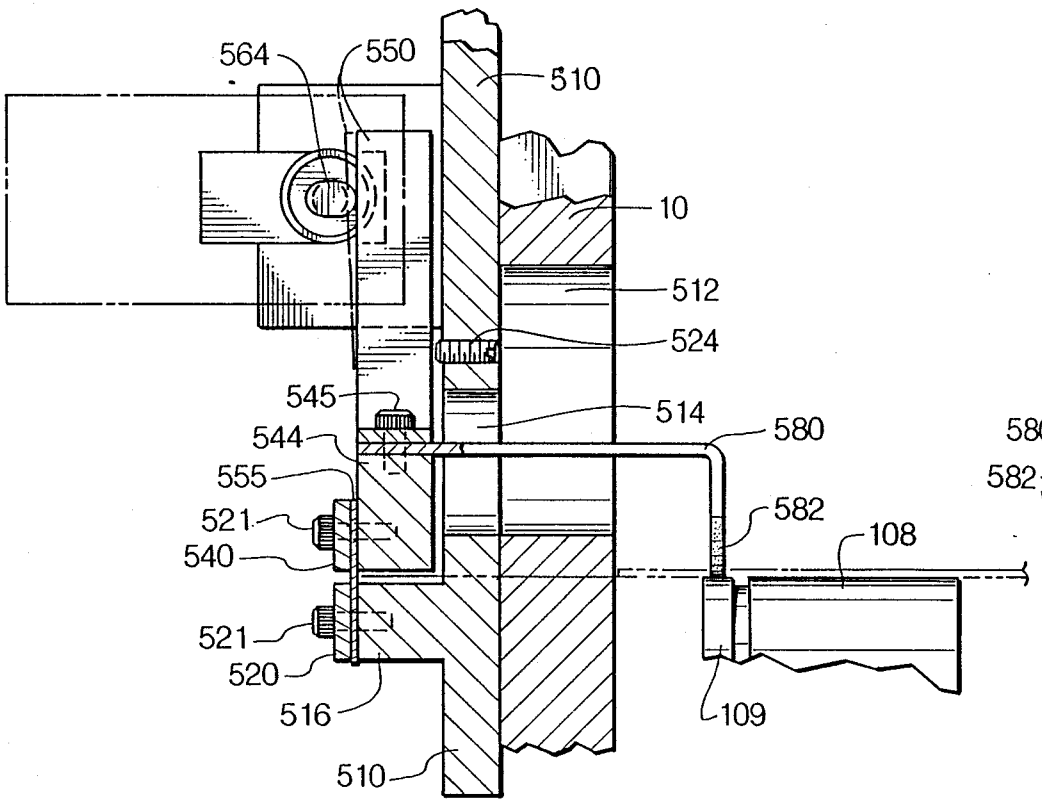
FIG. 11 is an enlarged view similar to that of FIG. 10, showing second alternate paper thickness monitor means.

FIGS. 11–12 show a variation of the embodiment shown in FIGS. 11, 12. In this embodiment, the thickness sensor roller 552 and the thickness sensor shaft 556 of FIGS. 9–10 are replaced by a thickness sensor blade 580 with a carbided or hardened glide surface 582. The use of this sensor blade 580 may permit the thickness sensor assembly to be more responsive, because of reduced mass. Deflection of the glide surface 582 is transmitted via thickness sensor blade 580 to the bracket 544, causing deflection of the plate 555 and motion of the interruptor leaf 550. This leads to the same function as the embodiment of FIGS. 9–10.

CONTROL SYSTEM AND OPERATION

FIG. 13 shows in block diagram form the elements of a control system for the present invention. At the heart of the control system is a digital data processing means 400 (preferably a Zylog Super 8 microprocessor) that is programmed to receive various input signals and issue control signals as described next.

When the system of the present invention is turned, on the data processing means 400 first determines the presence or absence of a sheet stack 20 by polling sheet stack sensor 32. If the stack is empty, the stack empty indicator 34 is set, and no sheet picking occurs If a sheet stack 20 is present, the data processing means 400 polls the sheet level sensor 60 for information on the position of the top sheet 22 relative to the optimal sheet stack height selected by adjustment of the base plate 62 relative to the magnet 59. If necessary, control signals are issued to the stack height adjustment mechanism 410 to raise or lower the sheet stack 20. To keep the sheet stack 20 at proper height this polling and actuation of the stack height adjustment mechanism is carried out at frequent intervals.

When the sheet stack 20 is at the right height, the data processing means 400 can issue a pick command signal to engage the pick clutch 430 to drive the feed belt 102 and to move the pick surface of the feed belt 102 into frictional engagement with the exposed, upper surface of the top sheet 22. This occurs when a pick command signal causes the pick solenoid 140 to lower the pick roller 106. At the same time the sensor arms 52 are lifted via pick lever 130 and link rod 84. The frictional engagement of the upper surface of the top sheet 22 by the feed belt 102 causes the top sheet 22 to move toward the dam 88, possibly bringing with it one or more sheets immediately below the top sheet 22. The dam 88 lifts the leading edge of the top sheet 22 and any closely following sheets. Usually this lifting helps separate the top sheet 22 from the ones below it. A single sheet or multiple sheets then enters the curve above the idling retard roller 108, which normally rotates freely with the motion of the feed belt 102 and the sheets it transports. Here, the first thickness sensor assembly 150 performs its function.

The single or multiple sheets at the idling retard roller 108 deflect the thickness sensor wheel 152 (roller 552 in FIGS. 9–10 or blade 580 in FIGS. 11–12), causing a change in the voltage produced at thickness sensor 162 (sensor 564 in FIGS. 9–12). The voltage magnitude depends on the thickness of the sheet or sheets present. The voltage from thickness sensor 162 is measured by data processing means 400 to determine if multiple sheets are present. If they are, the data processing means 400 issues control signals to brake electromagnet 94 to stop rotation of idler retard roller 108. With the brake pad 92 applied, the stationary idler retard roller 108 (which might also be driven in reverse) applies a strong frictional force to the lower surface of the group of two or more sheets on the idler retard roller 108. This usually breaks the top sheet 22 free to progress as a single picked sheet 26 into the second thickness sensor means 200. If the top sheet 22 still carries extra sheets with it into the gap at the second thickness wheel 210, this affects the voltage produced by second thickness sensor 232. When the voltage from thickness sensor 232 is communicated to data processing means 400, its measurement establishes the presence or absence of multiple sheets at second thickness sensor wheel 210. If multiple sheets are present, there is danger that multiple sheets will be processed downstream and cause errors. Accordingly, data processing means 400 sets the multiple sheet pick error indicator 420 and takes whatever other corrective action may be required, such as stopping pick drive roller 104, by means of pick clutch 430.

If only a single picked sheet 26 is present at the second thickness wheel 210, the picked sheet continues to be transported into the skew correction assembly 300, which is conventional and functions as described above to correct skew. That is, skew correction photosensor sets 322 communicate the presence of a skew condition to the data processing means 400, which sends signals to change the state of skew solenoids 352 and transport solenoids 358 to cause skew correction. The single, picked, skew-corrected sheet 26 is then edge-aligned with the wall plate 10 and ready to enter an optical scanner station (such as appears in U.S. Pat. Nos. 3,676,690 and 4,300,123) or other processing means.

It will be seen by those skilled in the art that various changes may be made without departing from the spirit and scope of the invention. For example, it will be clear that the invention could be implemented with other forms of sensors than Hall effect sensors and that other means of supporting the feed belt 102 for selective contact with the sheet stack 20 could be utilized. In addition, it will be seen that other forms of the brake assembly 90 could be used, such as a clutch controlling rotation of the idling retard roller 108 or a motor that could be stopped or reversed. Accordingly, the invention is not limited to what is shown in the drawings and described in the specification but only as indicated in the appended claims

What is claimed as new and desired to be protected by Letters Patent is:

1. An apparatus for removing a sheet from the top of a stack of sheets and transporting it laterally in the direction of a processing station comprising:

pick means for frictionally engaging the exposed surface of the top sheet and transporting it laterally substantially in the plane of the top of the stack;

angled dam means located adjacent the pick means for slidingly engaging the sheet edge and the sheet surface opposite the surface engaged by the pick means to lift sheets transported by said pick means out of the plane of the top of the stack;

first thickness sensor means for sensing the number of sheets that are transported past the dam; and brake means responsive to said first thickness sensor means for selectively applying a brake friction surface to the sheet surface opposite the surface engaged by the pick means when more than one sheet is transported past the dam.

2. The apparatus recited in claim 1 wherein said pick means for frictionally engaging the exposed surface of the top sheet is a continuous belt.

3. The apparatus as recited in claim 2 wherein said continuous belt means is mounted for selectively frictionally engaging the exposed surface of the top of a stack of sheets in response to a pick command from a data processing means.

4. The apparatus recited in claim 1 wherein the brake means comprises:

an idler wheel located opposite said pick means that engages the sheet surface opposite the surface engaged by the pick means and rotates with the sheet surface it engages; and and a brake operatively connected to said idler wheel for selectively stopping rotation of said idler wheel.

5. The apparatus recited in claim 1 further comprising a second thickness sensor means downstream from said brake means for sensing the number of sheets that are transported past said brake means.

6. The apparatus as recited in claim 5 further comprising error indicator means responsive to said second thickness sensor means for signalling an error condition if more than one sheet is transported past said brake means.

7. The apparatus as recited in claim 5 further comprising skew detection and correction means downstream from said second thickness sensor means 8. The apparatus as recited in claim 5 wherein said pick means is a continuous belt and further comprising means responsive to said second thickness sensor means for halting motion of said continuous belt if more than one sheet is transported past said brake means.

9. The apparatus as recited in claim 1 further comprising means for sensing the presence or absence of a stack of sheets.

10. The apparatus as recited in claim 1 wherein said pick means is an elongated continuous belt the center of the lower course of which is raised by an idler roller that bears against said lower course of said continuous belt.

11. The apparatus as recited.in claim 1 wherein said first thickness sensor means comprises:

a pair of wheels rotating on substantially parallel axes that are engaged at one point along their periphery to define a measuring gap at said one point;

mounting means on which at least one of said pair of wheels is mounted for rotation, said mounting means being deflected when one or more sheets enters the measuring gap; and means responsive to deflection of said mounting means for registering as an electrical signal the amount of deflection of said mounting means.

12. The apparatus as recited in claim 11 wherein said mounting means comprises:

a crank connected to said at least one of said pair of wheels;

a shaft connected to said crank that rotates in response to displacement of the axis of rotation of said at least one of said pair of wheels; and Hall effect sensor means connected to said shaft and producing a voltage dependent on the amount of displacement of the axis of rotation of said at least one of said pair of wheels.

13. The apparatus as recited in claim 1 further comprising:

level sensor means for contacting the top of the stack of sheets to sense the level of the top of said stack; and lift means operably connected to said level sensor means for raising said level sensor means out of contact with said stack when said pick means frictionally engages the exposed surface of the top sheet.

14. The apparatus as recited in claim 1 further comprising pick force control means for limiting the downward force exerted by said pick means on the top of the stack.

15. The apparatus as recited in claim 14 wherein the pick force control means comprises a mechanical linkage that includes as one element a bias spring of a selected spring rate that determines the downward force exerted by said pick means on the top of the stack.

* * * * *